US006346024B1

(12) United States Patent
Engel

(10) Patent No.: US 6,346,024 B1
(45) Date of Patent: Feb. 12, 2002

(54) BATH TOY WITH THERMALLY ERASABLE DRAWING SURFACE

(76) Inventor: Robert W. Engel, 548 N. Hollyburne La., Thousand Oaks, CA (US) 91360

( * ) Notice: Subject to any disclaimer, the term of this patent is extended or adjusted under 35 U.S.C. 154(b) by 0 days.

(21) Appl. No.: 09/505,452

(22) Filed: Feb. 11, 2000

(51) Int. Cl.[7] ..... A63H 33/00; A63H 13/15; A63H 33/30; A46B 11/08

(52) U.S. Cl. ..... 446/14; 446/146; 446/482; 401/1; 401/3

(58) Field of Search ..... 446/14, 146, 475, 446/482; 401/1, 2, 3

(56) References Cited

U.S. PATENT DOCUMENTS

| | | | | |
|---|---|---|---|---|
| 580,769 A | * | 4/1897 | Carter | 401/1 |
| 4,227,335 A | * | 10/1980 | Kuna et al. | 446/146 |
| 4,725,462 A | * | 2/1988 | Kimura | 446/14 |
| 4,917,643 A | * | 4/1990 | Hippely et al. | 446/14 |
| 5,011,445 A | * | 4/1991 | Nakasuji et al. | 446/14 |
| 5,375,271 A | | 12/1994 | Frankel | |
| 5,376,772 A | * | 12/1994 | Nakagawa et al. | 446/14 X |
| 5,501,601 A | * | 3/1996 | Todokoro et al. | 446/146 X |
| 5,509,844 A | * | 4/1996 | Poirier et al. | 446/482 X |
| 5,781,941 A | | 7/1998 | Radke et al. | |
| 5,786,838 A | * | 7/1998 | Steinhauser et al. | 347/179 |

FOREIGN PATENT DOCUMENTS

| | | |
|---|---|---|
| GB | 2086721 A | 5/1982 |
| GB | 2108838 A | 5/1983 |
| JP | 58-26236 | 2/1983 |

* cited by examiner

*Primary Examiner*—D Neal Muir
(74) *Attorney, Agent, or Firm*—O'Connell Law Firm

(57) ABSTRACT

A thermally erasable bath toy for enabling a user to create and erase drawing figures in a wet environment. The bath toy includes a drawing desk with a drawing surface that incorporates thermochromic material. A user can draw on the drawing surface by inducing the thermochromic material to enter its active temperature range, and the user can erase the drawing surface by inducing the thermochromic material to leave its active temperature range. The drawing desk can be caused to float atop a volume of water by incorporating or being formed of buoyant material or by housing an open inner volume. The color change in the thermochromic material can be induced by a temperature-operated drawing implement with a temperature applicator of heat transmissible material. The temperature applicator can include an elongate shaft that will act as a skeleton for a volume of insulative material. A weight at a proximal end of the shaft can help maintain a given temperature condition and cause a drawing tip to point out of a volume of water. Heat transmissible material can be retained in an open inner volume of the drawing implement. The heat transmissible material can be sealed within the drawing implement, retained within a removable hollow sheath, or inserted and evacuated through an opening in the open inner volume.

34 Claims, 5 Drawing Sheets

BATH TOY WITH THERMALLY ERASABLE DRAWING SURFACE

FIELD OF THE INVENTION

The present invention relates generally to entertainment devices. Stated more particularly, this patent disclose and protects a bath toy with a thermally erasable drawing surface for enabling a person, such a child, to write or draw thereon repeatedly in a wet environment.

BACKGROUND OF THE INVENTION

It will be readily appreciated that toys specifically designed for a person's use while bathing are well known in the art. Advantageously, such toys can make bathing, which tends to be an activity highly disfavored by many small children, substantially more interesting and pleasant for the child and for the child's caretaker. Since most children enjoy drawing and writing, a toy enabling children to do so conveniently and practically while taking a bath certainly would be useful.

Unfortunately, it appears that no bath toy has been disclosed that would permit a child to draw or write on the bath toy conveniently, practically, and repeatedly while in a bathtub or other wet environment. One can surmise that this state of the art is attributable to the fact that conventional writing media, such as ink, paint, or wax crayons, typically do not function well in a wet environment. Furthermore, one will recognize that conventional writing surfaces, such as paper, tend to become wet in a bathing environment whereupon they become substantially incapable of accepting ink, crayon, paint, or the like.

In light of this state of the art as summarized above, it will be apparent that there is a cognizable need for a bath toy that would enable a person, such as a child, to write or draw on a surface of the toy even when the bath toy is wet It is equally clear that there is a need for such a bath toy that would be able to be written or drawn on repeatedly without requiring the repair or replacement of the drawing surface or any other element of the toy.

SUMMARY OF THE INVENTION

Advantageously, the present invention sets forth with the broadly stated object of meeting the needs left by the prior art while providing a number of heretofore unrealized advantages thereover.

Stated more particularly, the invention is founded on the principle object of providing a bath toy that enables a child or other person to write or draw on one of its surfaces in a wet environment.

An additional object of the invention is to provide a bath toy with such a drawing surface that can be written and drawn on and then erased without damage thereto.

An underlying object of the invention is to provide a bath toy with a drawing surface that can be used repeatedly without repair or replacement of the drawing surface or any other element of the bath toy.

Undoubtedly, these and further objects and advantages of the instant invention will be obvious both to one who reviews the present disclosure and to one who has an opportunity to make use of an embodiment of the present invention for a bath toy.

In accomplishing these objects, a most basic embodiment of the present invention for a bath toy comprises a drawing desk with a drawing surface disposed thereon and a thermochromic material disposed over at least a portion of the drawing surface. When the thermochromic material is caused to enter its active temperature range, it will demonstrate a change in color at least from a first color to a second color. The active temperature range can be calibrated to be colder than typical room temperature. With this, the thermochromic material can be induced to change color from a first color to a second color by application of a chilled object to the drawing surface. Furthermore, the thermochromic material can be induced to change back to the first color by a warming of the thermochromic material. The drawing desk may include a means for enabling it to float atop a volume of water. This means may comprise a volume of buoyant material incorporated into the drawing desk. Alternatively, the means may comprise a watertight open inner volume within the drawing desk.

A temperature-operated drawing implement with a temperature applicator of heat transmissible material may be used for selectively inducing the thermochromic material to enter its active temperature range. The drawing implement may have a handle portion that retains a body portion of the temperature applicator. A volume of insulative material may surround the body portion of the temperature applicator for enabling the temperature applicator to maintain a given temperature condition. The temperature applicator can have a body portion that includes an elongate shaft that will function as a skeleton structure for the volume of insulative material. In such embodiments, an enlarged weight portion can be disposed adjacent to the proximal end of the elongate shaft such that the tip of the temperature applicator will tend to project from a volume of water in which the drawing implement floats.

Still more advantageously, the drawing implement could have an open inner volume for retaining a volume of heat transmissible material, such as water, so that, when the heat transmissible material is induced into a given temperature condition, the temperature applicator can be maintained at a desired temperature for an extended periods of time. The open inner volume can be watertight, and the elongate shaft can be disposed within the volume of heat transmissible material. Alternatively, the heat transmissible material can be retained within a hollow shelled sheath that can be removably engaged with the temperature applicator whereby a user can chill or heat a sheath of heat transmissible material prior to being engaged with the temperature applicator.

Still further, the open inner volume can be selectively sealed by a closure device such as an end cap whereby the open inner volume can be selectively filled with and evacuated of heat transmissible material. The heat transmissible material could comprise ice water, ice cubes, or a specially formed ice insert that corresponds in size and shape to the size and shape of the open inner volume. Ice inserts can be formed in a mold and then inserted into the open inner volume as necessary to maintain the temperature applicator in a given temperature condition. Where the open inner volume can be selectively filled with heat transmissible material, such as water, a collapsible member on an inner surface of the end cap can be included to prevent an overfilling of the open inner volume to prevent damage to the drawing implement upon freezing.

The handle portion of the drawing implement can be conical with a narrow end adjacent to the distal end of the handle portion and a wide end adjacent to the proximal end of the handle portion. In such a case, the temperature applicator can have a body portion that is conical with a narrow end adjacent to the distal end of the handle portion and a proximal end at a mid-portion of the handle portion. Also, the open inner volume can be frusta-conical with a distal end adjacent to the proximal end of the temperature applicator and a proximal end adjacent to the proximal end of the handle portion. With this, the end cap can be removed from the proximal end of the handle portion to allow heat transmissible material to be inserted into and removed from the frusta-conical open inner volume.

When a user desires to erase drawing figures that have been created on the drawing surface, he or she need only induce the thermochromic material to leave its active temperature range and enter its inactive temperature range. Where the thermochromic material is calibrated to have an active temperature range that is below room temperature such that the thermochromic material must be chilled to induce a color change, the user need only warm the thermochromic material to erase the drawing figures. Of course, this could be done in a number of ways. For example, where the drawing desk floats atop a surface of warm bath water, the user need only temporarily submerge the floating structure by pushing downwardly thereon. With this, the warm bath water will wash over the drawing surface and warm the thermochromic material to its inactive temperature range whereby the drawing surface will appear blank and ready to be used again. Alternatively, the user might employ a spray erasing device to spray warm liquid onto the drawing surface. Most advantageously, the spray erasing device could be a hand-operated pump that draws warm bath water from the bath tub through an inlet tube to be sprayed onto the drawing surface. With such a device, the user could choose to erase the entire drawing surface or to erase only certain drawing figures.

Of course, one should remain mindful that the foregoing discussion is designed merely to outline broadly the more important features of the invention to enable a better understanding of the detailed description that follows and to instill a better appreciation of the inventor's contribution to the art. Before an embodiment of the invention is explained in detail, it must be made dear that the following details of construction, descriptions of geometry, and illustrations of inventive concepts are mere examples of possible manifestations of the broader invention revealed herein.

DETAILED DESCRIPTION OF PREFERRED EMBODIMENTS

To assist one in better understanding and, in appropriate circumstances, practicing the invention, certain preferred embodiments of the present invention for a bath toy are shown in the accompanying figures and are described with particularity below.

Figure 1:
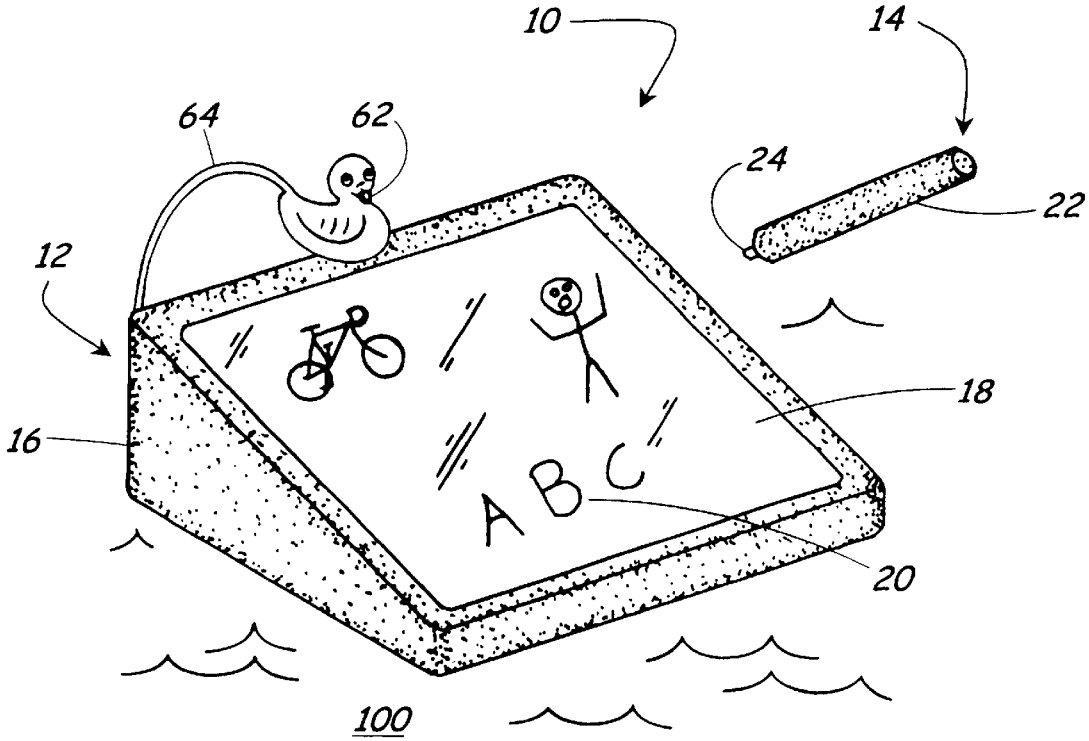
FIG. 1 is a perspective view of a bath toy according to the present invention.

Looking more particularly to FIG. 1, one sees an embodiment of the bath toy indicated generally at 10. In this preferred embodiment, the bath toy 10 comprises a combination of a drawing desk 12 and a temperature-operated drawing implement 14. The drawing desk 12 is founded on a floating base 16 that can float on a water surface 100 of a bathtub or the like (not shown). Retained on an upper surface of the floating base 16 is a drawing surface 18 for receiving drawing figures, such as those indicated at 20, in a manner that will be discussed more fully hereinbelow. The drawing implement 14 essentially comprises a handle portion 22 and a temperature applicator 24. In use, the temperature applicator 24 interacts with the drawing surface 18 to enable the creation of drawing FIGS. 20 on the drawing surface 18.

Referring more particularly to the drawing desk 12, one will again note that it is founded on a floating base 16. Of course, although this preferred embodiment of the drawing desk 12 incorporates a floating base 16, one will recognize that the drawing desk 12 need not necessarily float. For example, the drawing desk 12 could have legs (not shown) for sustaining it above a water level, or it could be sufficiently tall such that it would stand above typical water levels without assistance. One will further recognize that the means for causing the drawing desk 12 to float could assume a variety of forms. For example, and possibly most preferably, the drawing desk 12 could have a floating base 16 constructed from a naturally buoyant material such as molded or closed cell foam. Foam material may be considered advantageous due to its natural buoyancy, thermally insulative properties, softness, lightness, and consequent safety for use by children.

Figure 2:
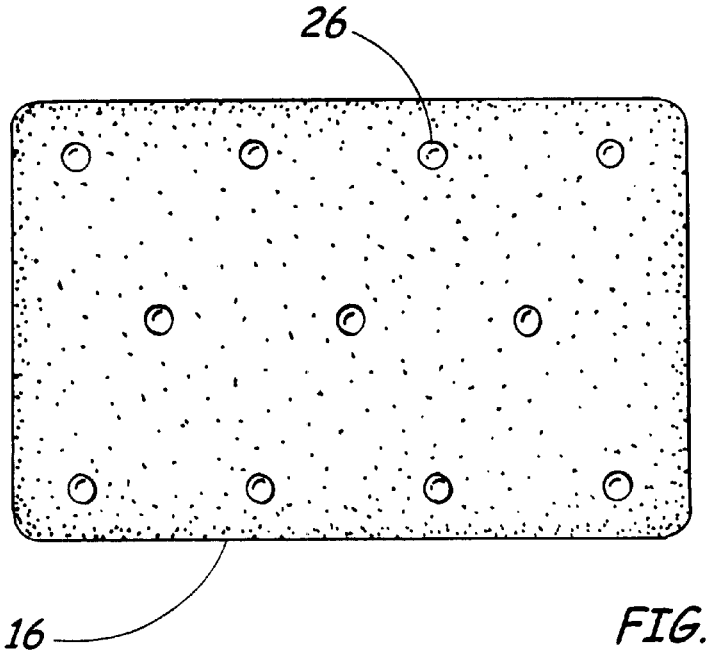
FIG. 2 is a bottom plan view of a drawing desk according to the present invention.

However, the floating base 16 alternatively could achieve buoyancy by being formed of a polymeric material with a watertight open inner volume. Also, as is indicated in FIG. 2, the floating base 16 could further include a plurality of suction cups 26 fixed to its rear or bottom surface. With this, the drawing desk 12 could be removably coupled to a bathtub wall or the like (not shown). When so coupled, the drawing desk 12 could function as an easel, blackboard, or similar structure.

Figure 3:
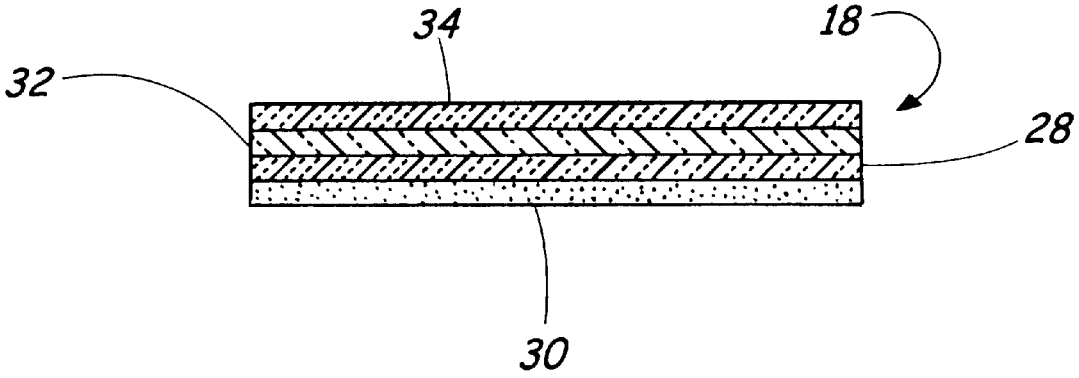
FIG. 3 is a cross-sectional view of a preferred drawing surface for the bath toy.

Looking in greater detail to the drawing surface 18, which is shown generally in FIG. 1 and in greater detail in the cross-sectional view of FIG. 3, which is not to scale, one sees that the drawing surface 18 is based on a substrate layer 28. The substrate layer 28 could take many forms but preferably will comprise a thin, flexible pad of material, such as vinyl plastic or the like. In this embodiment, the substrate layer 28, and thus the drawing surface 18 in general, is fixed to the floating base 16 by a layer of adhesive 30. Although it is not shown, the substrate layer 28 could be fixed to the floating base 16 by heat sealing or by any other effective means.

The opposing surface of the substrate layer 28 is coated with a layer of thermochromic material 32 that, as its name would suggest, changes color in response to a change in temperature. In this embodiment, a translucent, preferably transparent, protective layer 34 of, for example, clear plastic overlies the layer of thermochromic material 32 for protecting the thermochromic material 32 from abrasion and other damage that might otherwise result from contact with the drawing implement 14 or other articles. The protective layer 34 must be sufficiently thin to permit substantially unhindered heat transfer between the drawing tip 24 of the drawing implement 14 and the thermochromic material 32 underlying the protective layer 34.

The thermochromic material 32 could be of a variety of types. For example, it could comprise thermochromic ink or thermochromic liquid crystal mesophase material. The basic requirement is that it demonstrate a change in color in response to a change in temperature. Thermochromic ink and thermochromic liquid crystal mesophase material are advantageous because they can exhibit one or more reversible color changes as they are caused to change temperature, either by being warmed or cooled. Such thermochromic materials can be calibrated or chosen to experience a variety of reversible color changes, such as from at least a first color to a second color, from colorless to colored or vice versa in response to being heated or cooled through a predetermined temperature range. Although one skilled in the art would certainly be readily enabled to understand and, in appropriate circumstances, practice the invention in this respect from the foregoing discussion, one may note that a detailed discussion of the composition, manufacture, use and characteristics of various exemplary thermochromic materials is set forth in U.S. Pat. No. 4,028,118 to Nakasuji et al., which is aptly entitled "Thermochromic Materials."

Although the particular color change characteristics of the thermochromic material 32 could be readily varied within the scope of the invention, one presently preferred thermochromic material 32 will be calibrated to exhibit a color change from a first color to a second color when cooled from a first temperature, such as an approximate bathing room temperature of approximately 70 to 80 degrees Fahrenheit, to a second predetermined temperature, such as approximately 55 degrees Fahrenheit, and to return to the first color when warmed to the first temperature. The thermochromic material 32 could have substantially identical thermochromic properties over the entire drawing surface 18. Alternatively, thermochromic materials 32 of different thermochromic properties (i.e., temperature ranges, particular colors) can be applied in different regions of the drawing surface 18. With this, different portions of the drawing surface 18 can be crafted to exhibit color changes at different temperatures and, alternatively or additionally, to exhibit different colors over substantially identical temperature ranges.

The astute observer may appreciate that, where the floating base 16 is formed of a polymeric material with a watertight open inner volume, issues may arise because the floating base 16 may not exhibit the thermally insulative properties that a solid or substantially solid foam floating base 16 might In such a case, it may be necessary to interpose a thermally insulative layer (not shown) between the floating base 16 and the drawing surface 18. Such a thermally insulative layer advantageously would prevent heat transfer such as from warm bath water to the drawing surface 18, which would likely cause premature erasure of the drawing FIG. 20.

Figure 4:
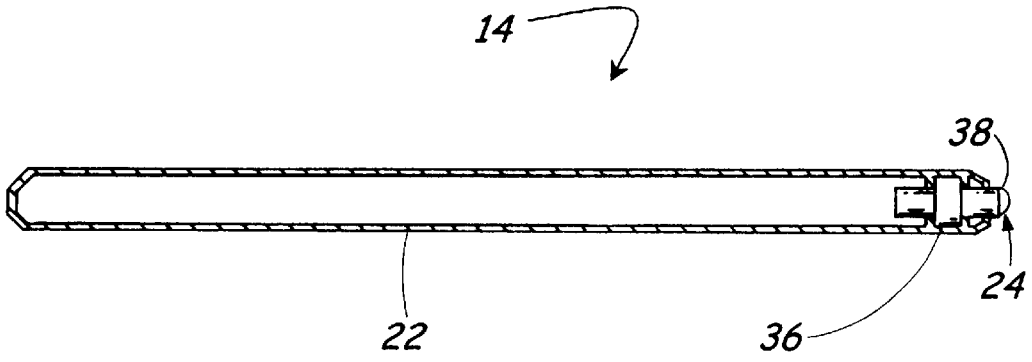
FIG. 4 is a cross-sectional view of a drawing implement according to the present invention.

Considering more particularly the drawing implement 14 of the present invention, one will see the most basic embodiment of the drawing implement 14 depicted in FIG. 1 shown in more detail in FIG. 4. Again, the drawing implement 14 is shown to have a handle portion 22 and a temperature applicator 24. The handle portion 22 could be formed from a variety of materials but may be formed most preferably from plastic or the like. The temperature applicator 24 is preferably formed from a heat transmissible material, such as metal, that has relatively high thermal conductivity and a low specific heat. Preferred metals include aluminum, copper, and stainless steel. The temperature applicator 24 has an enlarged body portion 36 that resides within and is retained by the handle portion 22. A polished, rounded drawing tip 38 of the temperature applicator 24 projects beyond the handle portion 22.

Under this most basic embodiment, a user, such as a child, can draw upon the drawing surface 18 by first dipping at least the drawing tip 38 of the temperature applicator 24 into a reservoir (not shown) containing cold, preferably ice, water to chill the drawing tip 38 and, over sufficient time, the entire temperature applicator 24. Once the drawing tip 38 and preferably the entire temperature applicator 24 are sufficiently chilled, the user can apply the drawing tip 38 to the drawing surface 18 thereby inducing a downward change in temperature, and thus a change in color, in the thermochromic material 32 in the area to which the drawing tip 38 has been applied. Stated alternatively, the thermochromic material 32 adjacent to the drawing tip 38 will be chilled to its active temperature range whereupon that thermochromic material 32 will exhibit a color change. With this, a user, such as a child, can employ the drawing implement 14 to create a drawing FIG. 20 of his or her choosing on the drawing surface 18.

To erase the drawing FIG. 20, a user need only induce the thermochromic material 32 to reenter its inactive temperature range. For example, where the drawing desk 12 floats atop a volume of bath water or the like, the user need only push the drawing desk 12 downward to submerse it in the warm water. With this, the thermochromic material 32 will be warmed to within its inactive temperature range so that the drawing surface 18 will assume its single initial single color whereby it will be effectively blank. Advantageously, a user can then employ the drawing implement 14 to create new drawing FIG. 20 and can repeat the process endlessly without needing to replace or repair the drawing surface 18.

As one may perceive from FIG. 1, the drawing surface 18 alternatively may be erased by use of a spray erasing device 62 that can be removably or fixedly attached to the floating base 16. The spray erasing device 62 can be operated with a typical hand-operated pump mechanism of a type well known in the art that will draw warm water from the volume of bath water 100 through an inlet tube 64. The spray erasing device 62 enables a user to direct a stream or spray of warm water from the tub onto selected portions of the drawing surface 18 or over the entire drawing surface 18. With this, a child can choose to erase only certain drawing FIG. 20 from the drawing surface 18 or, instead, all drawing FIG. 20 from the drawing surface 18. As FIG. 1 shows, the exterior of the spray erasing device 62 may be fashioned in the shape of an animal or cartoon character.

Figure 5:
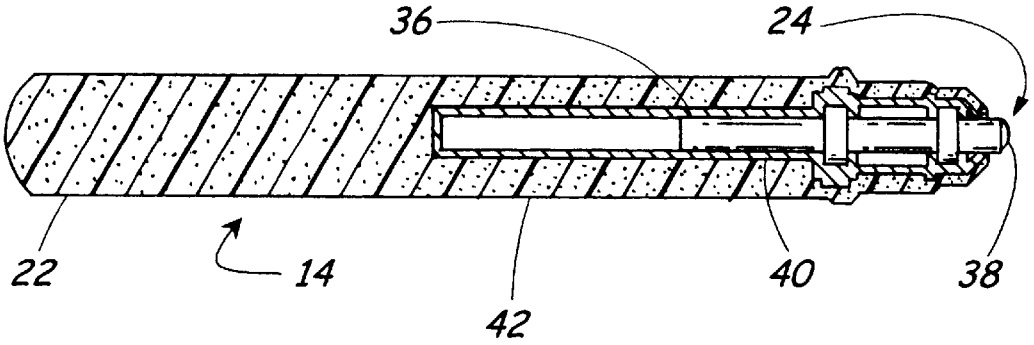
FIG. 5 is a cross-sectional view of an alternative embodiment of the drawing implement.

Although the abovedescribed basic embodiment of the drawing implement 14 certainly would be effective for inducing a color change in the thermochromic material 32, the inventor has devised of a plurality of refined embodiments of the drawing implement 14. One such embodiment is shown in FIG. 5 where the drawing implement 14 again has a handle portion 22 that retains a temperature applicator 24. However, in this embodiment, the temperature applicator 24 is elongated and encased in a plastic sheath 40 to ensure that it is safe for use by children. Furthermore, the plastic sheath 40 and all but the distal end of the drawing tip 38 are encased in a volume of insulative material 42, such as foam With this, the temperature applicator 24 and the drawing tip 38 will tend to be retained in a desired temperature condition, namely chilled, and the insulative material 42 will insulate a users hands from the chilling effect of the drawing tip 24. Furthermore, the foam insulative material 42 will cause the drawing implement 14 to tend to float.

Figure 6:
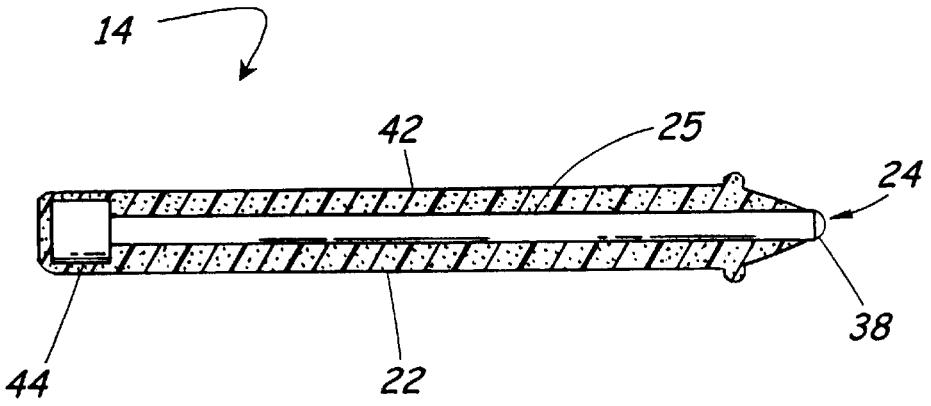
FIG. 6 is a cross-sectional view of another embodiment of the drawing implement.

Another embodiment of the drawing implement 14 is shown in FIG. 6 where it again incorporates a temperature applicator 24 and a handle portion 22. However, in this embodiment, the temperature applicator 24 further comprises a shaft portion 25 that extends along substantially the entire length of the handle portion 22 to form a metal core. Except for its distal end, which comprises the rounded drawing tip 38, the temperature applicator 24 is encased in a volume of foam insulative material 42. Also, a weight 44 is affixed to the proximal end of the shaft portion 25 of the temperature applicator 24. A plurality of advantages derive from this construction. For example, when the drawing implement 14 floats in a volume of water, the weight 44 at the proximal end of the shaft portion 25 of the temperature applicator 24 will tend to weigh down that end of the drawing implement 14 to cause the rounded drawing tip 38 to project out of the warm water thereby allowing the temperature applicator 24 and the drawing tip 38 to remain chilled longer. Also, the elongate temperature applicator 24 will automatically eliminate any dangers due to small parts. Still further, the added mass of the temperature applicator 24 will allow it to retain its temperature for a longer time. Even further still, by extending along substantially the entire length of the handle portion 22, the elongate temperature applicator 24 acts as a skeleton structure for the foam insulative material 42.

Figure 7:
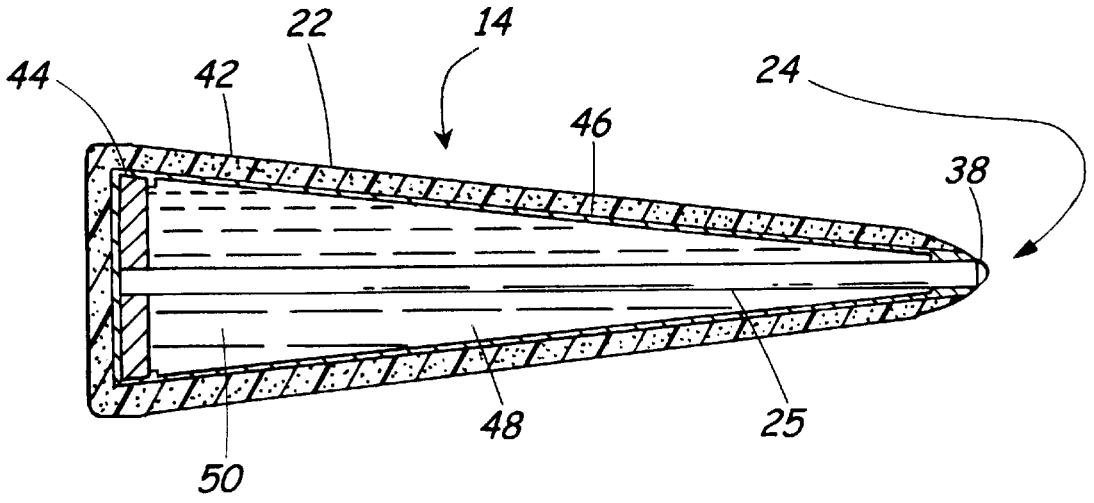
FIG. 7 is a cross-sectional view of still another embodiment of the drawing implement.

FIG. 7 depicts yet another embodiment of the drawing implement 14. In this embodiment, the temperature applicator 24 again comprises an elongate shaft portion 25 that terminates at a distal end in a rounded drawing tip 38 and at a proximal end with a weight 44 for biasing the drawing tip 38 to project from a volume of water in which the drawing implement 14 rests. In this embodiment, however, a conical watertight housing 46 with an open inner volume 48 surrounds the shaft portion 25 and weight 44 of the temperature applicator 24. A volume of heat transmissible, freezable liquid 50, such as water, is retained within the open inner volume 48, and a volume of insulative material 42 envelopes and insulates the watertight housing 46. With this, the freezable liquid 50 can be pre-frozen prior to using the drawing implement 14 so that the temperature applicator 24 and thus the drawing tip 38 will remain in a chilled condition for an elongated period of time.

Figure 8:
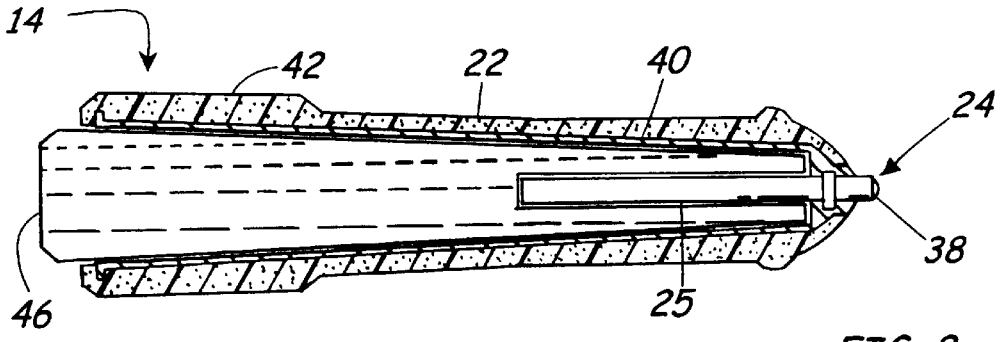
FIG. 8 is a cross-sectional view of yet another embodiment of the drawing implement.

The embodiment of the drawing implement 14 shown in FIG. 8 is similar in many respects to the embodiment of FIG. 7. However, in this case the watertight housing 46 is removably received within a plastic sheath 40. With this, the watertight housing 46 can be placed in a freezer until frozen or merely cold and then installed in the plastic sheath 40. Furthermore, a user could employ multiple watertight housings 46 so that an active watertight housing 46 can be installed in the plastic sheath 40 while one or more other watertight housings 46 are being chilled. The plastic sheath 40 also retains the temperature applicator 24, which in this embodiment has an elongate shaft 25 that extends only partially along the length of the handle portion 22. The temperature applicator 24 in this embodiment is devoid of the weight 44 found in the embodiment of FIG. 7.

Figure 9:
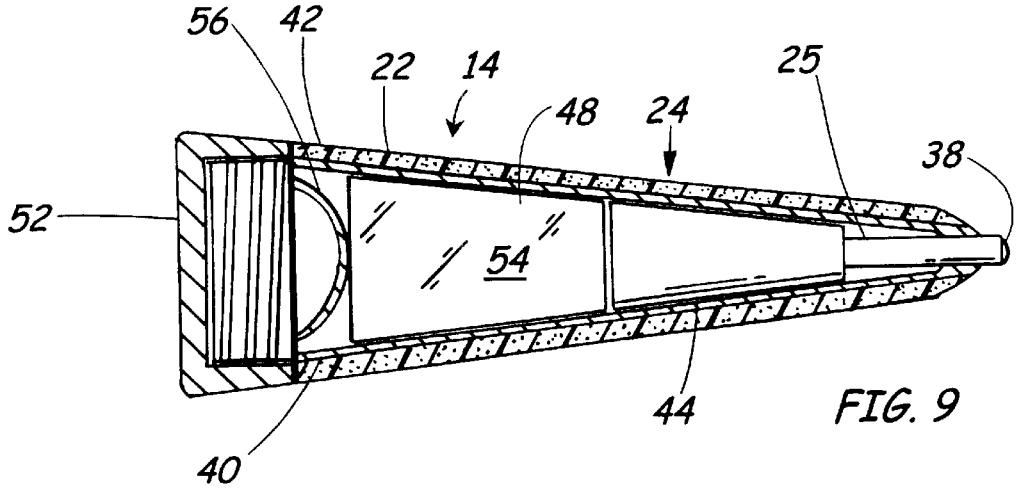
FIG. 9 is a cross-sectional view of a still further embodiment of the drawing implement.

FIG. 9 depicts still another embodiment of the drawing implement 14 that is again based on a temperature applicator 24. The temperature applicator 24 has an abbreviated shaft portion 25 that terminates at a distal end in a rounded drawing tip 38 and at a proximal end in a broadened weight 44. In this embodiment, the weight 44 comprises a truncated conical shape that acts as a metal heat sink for assisting the temperature applicator 24 and the drawing tip 38 in remaining in a chilled temperature condition. A conical plastic sheath 40 encases the temperature applicator 24 except for the drawing tip 38 and further defines an open inner volume 48 to the proximal side of the weight 44. The open proximal end of the plastic sheath 40 can be sealingly closed by an end cap 52 that is threadedly engaged with the plastic sheath 40. With the end cap 52 engaged with the plastic sheath 40, the open inner volume 48 will be watertight.

Advantageously, a user can insert a cold material such as a volume of ice water, a mixture of ice cubes or, most preferably, a specially formed ice insert 54 into the conical open inner volume 48. Alternatively, the open inner volume 48 can be filled with a volume of water, and the entire drawing implement 14 can be inserted into a freezer to chill or freeze the water. To prevent the open inner volume 48 from being overfilled, which could damage the drawing implement 14 during freezing, the end cap 52 could be provided with a collapsible dome 56 of plastic or rubber. In use, the collapsible dome 56 would drive excess water from within the open inner volume 48 as the end cap 52 is engaged with the plastic sheath 40 and would tend to collapse as the water within the open inner volume 48 freezes. To insulate the drawing implement 14, substantially the entire sheath 40 and end cap 52 are encased in a volume of insulative foam 42.

Figure 10:
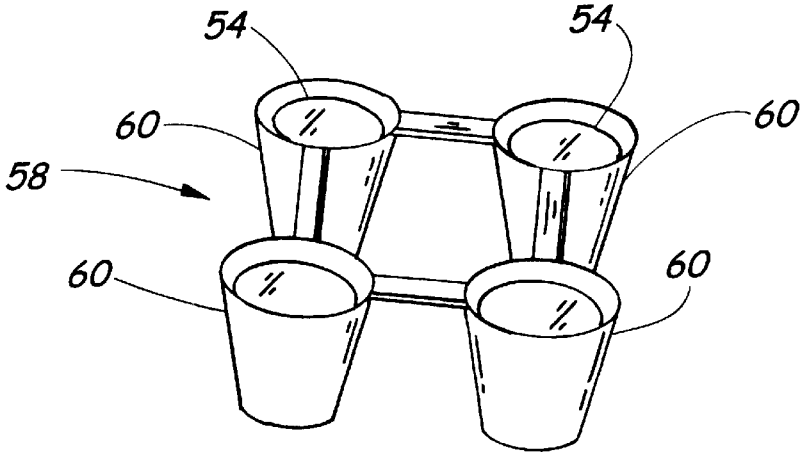
FIG. 10 is a perspective view of an ice mold for use according to the present invention.

As FIG. 10 indicates, the specially formed ice insert 54 can be created most advantageously by use of an ice mold 58 that includes a plurality of interconnected truncated cone molds 60. Each of the cone molds 60 are sized and shaped to yield an ice insert 54 that will correspond to the size and shape of the truncated conical open inner volume 48. With this, a user could fill each cone mold 60 with water, place the ice mold 58 into a freezer to create four ice inserts 54. The ice inserts 54 could then be inserted and replaced within the open inner volume 48 as necessary to maintain the temperature applicator 24 in a chilled condition.

One will appreciate that, although the invention has been described as requiring that the thermochromic material 32 of the drawing surface 18 be chilled to enter its active temperature range, it is well within the scope of the invention to have the thermochromic materials 32 exhibit color changes in response to other temperature modifications. For example, although it may not be preferable, it would be well within the scope of the invention to calibrate the thermochromic material 32 to have an active temperature range that is higher than normal room or bath water temperature. With this, the drawing implement 14 could be heated and applied to the drawing surface 18 to cause the thermochromic material 32 to demonstrate a change in color.

In light of the foregoing, it will be clear that the present invention achieves a number of advantages over the prior art. Most basically, the bath toy 10 enables a child or other person to write or draw on its drawing surface 18 in a wet environment, such as a volume of bath water 100. Since the invention employs thermochromic material 32, which may be protected by a protective layer 34, the drawing surface 18 can be written on and erased without damage thereto. With this, the bath toy 10 can be used repeatedly without needing to repair or replace the drawing surface 18 or any other element of the bath toy 10. These and further objects and advantages of the bath toy 10 undoubtedly will occur both to one who has reviewed the present disclosure and to one who has an opportunity to make use of an embodiment of the present invention for a bath toy 10.

Furthermore, one will appreciate that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments set forth above.

Accordingly, it must be recognized that the following claims are intended to define the scope of protection to be afforded to the inventor, and the claims shall be deemed to include equivalent constructions insofar as they do not depart from the spirit and scope of the present invention. It should be recognized further that a plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. A thermally erasable bath toy for enabling a user to create and erase drawing figures in a wet environment, the bath toy comprising:

a drawing desk;

a non-electrical drawing surface disposed on the drawing desk;

a thermochromic material disposed over at least a portion of the drawing surface wherein the thermochromic material has an active temperature range wherein the thermochromic material will demonstrate a change in color at least from a first color to a second color; and a means for enabling the drawing desk to float atop a volume of water;

whereby a user can induce a change in color in the thermochromic material at least from a first color to a second color by inducing the thermochromic material to enter its active temperature range so that a user can create drawing figures on the drawing surface and whereby the thermochromic material will exhibit a change in color at least from the second color back to the first color as the thermochromic material leaves its active temperature range whereby the drawing figures can be erased from the drawing surface by a submersion of the drawing surface in the volume of water.

2. The bath toy of claim 1 wherein the means for enabling the drawing desk to float atop a volume of water comprises a volume of buoyant material operably associated with the drawing desk.

3. The bath toy of claim 2 wherein the means for enabling the drawing desk to float atop a volume of water comprises a floating base that is formed substantially entirely from a buoyant material.

4. The bath toy of claim 1 wherein the means for enabling the drawing desk to float atop a volume of water comprises a watertight open inner volume operably associated with the drawing desk.

5. The bath toy of claim 1 further comprising a temperature-operated drawing implement of heat transmissible material for selectively inducing the thermochromic material on the drawing surface to enter the active temperature range of the thermochromic material.

6. The bath toy of claim 5 wherein the drawing implement comprises a temperature applicator for being brought into a given temperature condition and for being applied to the thermochromic material on the drawing surface to induce the thermochromic material to enter the active temperature range of the thermochromic material wherein the temperature applicator has a body portion and a drawing tip.

7. The bath toy of claim 6 wherein the drawing implement further comprises a handle portion for retaining the body portion of the temperature applicator wherein the handle portion has a distal end adjacent to the drawing tip of the temperature applicator and a proximal end.

8. The bath toy of claim 7 wherein the handle portion comprises a volume of insulative material surrounding the body portion of the temperature applicator but leaving the drawing tip of the temperature applicator exposed.

9. The bath toy of claim 8 wherein the handle portion further comprises a rigid sheath that surrounds and retains the temperature applicator wherein the volume of insulative material surrounds the sheath.

10. The bath toy of claim 8 wherein the body portion of the temperature applicator comprises an elongate shaft with a distal end comprising the drawing tip and a proximal end whereby the elongate shaft functions as a skeleton structure for the volume of insulative material.

11. The bath toy of claim 7 further comprising an open inner volume with a given shape and size within the drawing implement for retaining a volume of heat transmissible material in heat transmittable association with the temperature applicator.

12. The bath toy of claim 11 wherein the open inner volume within the drawing implement is watertight and further comprising a volume of heat transmissible liquid retained in the open inner volume within the drawing implement whereby the temperature applicator can be retained in a desired temperature condition for a given period of time by a bringing of the heat transmissible liquid into a desired temperature condition.

13. The bath toy of claim 12 wherein the body portion of the temperature applicator comprises an elongate shaft with a distal end comprising the drawing tip and a proximal end and wherein the elongate shaft is disposed within the volume of heat transmissible material.

14. The bath toy of claim 6 wherein the drawing implement further comprises a sheath of heat transmissible material removably engagable with the temperature applicator.

15. The bath toy of claim 14 wherein the sheath comprises a hollow shell with a volume of heat transmissible material retained therein.

16. The bath toy of claim 15 further comprising a volume of insulative material surrounding the sheath of heat transmissible material.

17. The bath toy of claim 11 further comprising a closure device for selectively sealing the open inner volume whereby the open inner volume can be selectively filled with and evacuated of heat transmissible material.

18. The bath toy of claim 17 wherein the closure device comprises an end cap removably couplable with the proximal end of the handle of the drawing implement whereby a volume of heat transmissible material can be selectively inserted into and evacuated from the open inner volume through the proximal end of the handle.

19. The bath toy of claim 18 further comprising a mold with a volume defining a size and shape that approximates the size and shape of the open inner volume within the drawing implement whereby a specially formed insert can be molded in the mold from a heat transmissible liquid for insertion into the open inner volume of the drawing implement.

20. The bath toy of claim 1 further comprising a spray erasing device operably associated with the drawing surface for erasing drawing figures from the drawing surface by spraying liquid onto the drawing surface.

21. The bath toy of claim 20 wherein the spray erasing device comprises a hand-operated pump and an inlet tube operably associated with the hand-operated pump for drawing liquid from a volume of liquid and spraying the liquid onto the drawing surface.

22. A thermally erasable bath toy for enabling a user to create and erase drawing figures in a wet environment, the bath toy comprising:

a drawing desk;

a drawing surface disposed on the drawing desk; and a thermochromic material disposed over at least a portion of the drawing surface wherein the thermochromic material has an active temperature range wherein the thermochromic material will demonstrate a change in color at least from a first color to a second color;

a temperature-operated drawing implement of heat transmissible material for selectively inducing the thermochromic material to enter its active temperature range wherein the drawing implement comprises a temperature applicator for being brought into a given temperature condition and for being applied to the thermochromic material on the drawing surface to induce the thermochromic material to enter its active temperature range wherein the temperature applicator has a body portion and a drawing tip and wherein the drawing implement further comprises a handle portion for retaining the body portion of the temperature applicator wherein the handle portion has a distal end adjacent to the drawing tip of the temperature applicator and a proximal end, wherein the handle portion comprises a volume of insulative material surrounding the body portion of the temperature applicator but leaving the drawing tip of the temperature applicator exposed, and wherein the body portion of the temperature applicator comprises an elongate shaft with a distal end comprising the drawing tip, a proximal end, and an enlarged weight portion disposed adjacent to the proximal end of the elongate shaft whereby the elongate shaft functions as a skeleton structure for the volume of insulative material;

whereby a user can induce a change in color in the thermochromic material at least from a first color to a second color by inducing the thermochromic material to enter its active temperature range so that a user can create drawing figures on the drawing surface and whereby the thermochromic material will exhibit a change in color at least from the second color back to the first color as the thermochromic material leaves its active temperature range whereby the drawing figures can be erased from the drawing surface.

23. A thermally erasable bath toy for enabling a user to create and erase drawing figures in a wet environment, the bath toy comprising:

a drawing desk;

a drawing surface disposed on the drawing desk; and a thermochromic material disposed over at least a portion of the drawing surface wherein the thermochromic material has an active temperature range wherein the thermochromic material will demonstrate a change in color at least from a first color to a second color;

whereby a user can induce a change in color in the thermochromic material at least from a first color to a second color by inducing the thermochromic material to enter its active temperature range so that a user can create drawing figures on the drawing surface and whereby the thermochromic material will exhibit a change in color at least from the second color back to the first color as the thermochromic material leaves its active temperature range whereby the drawing figures can be erased from the drawing surface;

a temperature-operated drawing implement of heat transmissible material for selectively inducing the thermochromic material on the drawing surface to enter its active temperature range wherein the drawing implement comprises a temperature applicator for being brought into a given temperature condition and for being applied to the thermochromic material on the drawing surface to induce the thermochromic material to enter its active temperature range wherein the temperature applicator has a body portion and a drawing tip and wherein the drawing implement further comprises a handle portion for retaining the body portion of the temperature applicator wherein the handle portion has a distal end adjacent to the drawing tip of the temperature applicator and a proximal end;

an open inner volume with a given shape and size whithin the drawing implement for retaining a volume of heat transmissible material in heat transmittable association with the temperature applicator;

a closure device for selectively sealing the open inner volume whereby the open inner volume can be selectively filed with and evacuated of heat transmissible material; and a collapsible member operably associated with the open inner volume of the drawing implement whereby the open inner volume can be filled with a volume of heat transmissible liquid and the liquid can be frozen without causing damage to the drawing implement.

24. The bath toy of claim 18 wherein the handle portion of the drawing implement is conical with a narrow end adjacent to the distal end of the handle portion and a wide end adjacent to the proximal end of the handle portion, wherein the temperature applicator has a body portion that is conical with a narrow end adjacent to the distal end of the handle portion and a proximal end at a mid-portion of the handle portion, wherein the open inner volume is frusta-conical with a distal end adjacent to the proximal end of the temperature applicator and a proximal end adjacent to the proximal end of the handle portion whereby the end cap can be removed from the proximal end of the handle portion to allow heat transmissible material to be inserted into and removed from the frusta-conical open inner volume.

25. The bath toy of claim 18 wherein the temperature applicator has a body portion a proximal end at a mid-portion of the handle portion and wherein the open inner volume has a distal end adjacent to the proximal end of the temperature applicator and a proximal end adjacent to the proximal end of the handle portion whereby the end cap can be removed from the proximal end of the handle portion to allow heat transmissible material to be inserted into and removed from the open inner volume.

26. A temperature-operated drawing implement comprising:

a temperature applicator of heat transmissible material with a body portion and a drawing tip;

a handle portion for retaining the body portion of the temperature applicator wherein the handle portion has a distal end adjacent to the drawing tip of the temperature applicator and a proximal end;

wherein the body portion of the temperature applicator comprises an elongate shaft with a distal end comprising the drawing tip and a proximal end and further comprising a volume of insulative material surrounding the elongate shaft whereby the elongate shaft functions as a skeleton structure for the volume of insulative material; and wherein the body portion of the temperature applicator further comprises an enlarged weight portion disposed adjacent to the proximal end of the elongate shaft.

27. The drawing implement of claim 26 further comprising an open inner volume with a given shape and size with the handle portion of the drawing implement for retaining a volume of heat transmissible material in heat transmittable association with the temperature applicator.

28. The drawing implement of claim 27 wherein the open inner volume is watertight and further comprising a volume of heat transmissible liquid retained in the open inner volume whereby the temperature applicator can be retained in a desired temperature condition for an extended period of time by a bringing of the heat transmissible liquid into a desired temperature condition.

29. The drawing implement of claim 26 further comprising a sheath of heat transmissible material removably engagable with the temperature applicator.

30. The drawing implement of claim 27 further comprising a closure device for selectively sealing the open inner volume whereby the open inner volume can be selectively filled with and evacuated of heat transmissible material.

31. The drawing implement of claim 30 wherein the closure device comprises an end cap removably couplable with the proximal end of the handle of the drawing implement whereby a volume of heat transmissible material can be selectively inserted into and evacuated from the open inner volume through the proximal end of the handle.

32. A temperature-operated drawing implement comprising:

a temperature applicator of heat transmissible material with a body portion and a drawing tip a handle portion for retaining the body portion of the temperature applicator wherein the handle portion has a distal end adjacent to the drawing tip of the temperature applicator and a proximal end;

an open inner volume with a given shape and size within the handle portion of the drawing implement for retaining a volume of heat transmissible material in heat transmittable association with the temperature applicator;

a closure device for selectively sealing the open inner volume whereby the open inner volume can be selectively filled with and evacuated of heat transmissible material wherein the closure device comprises an end cap removably couplable with the proximal end of the handle of the drawing implement whereby a volume of heat transmissible material can be selectively inserted into and evacuated from the open inner volume through the proximal end of the handle; and a mold with a volume defining a size and shape that approximates the size and shape of the open inner volume whereby a specially formed insert can be molded in the mold from a heat transmissible liquid for insertion into the open inner volume.

33. A temperature-operated drawing implement comprising:

a temperature applicator of heat transmissible material with a body portion and a drawing tip;

a handle portion for retaining the body portion of the temperature applicator wherein the handle portion has a distal end adjacent to the drawing tip of the temperature applicator and a proximal end;

an open inner volume with a given shape and size within the handle portion of the drawing implement for retaining a volume of heat transmissible material in heat transmittable association with the temperature applicator;

a closure device for selectively sealing the open inner volume whereby the open inner volume can be selectively filled with and evacuated of heat transmissible material wherein the closure device comprises an end cap removably couplable with the proximal end of the handle of the drawing implement whereby a volume of heat transmissible material can be selectively inserted into and evacuated from the open inner volume through the proximal end of the handle; and wherein the handle portion is conical with a narrow end adjacent to the distal end of the handle portion and a wide end adjacent to the proximal end of the handle portion, wherein the temperature applicator has a body portion that is conical with a narrow end adjacent to the distal end of the handle portion and a proximal end at a mid-portion of the handle portion, wherein the open inner volume is frusta-conical with a distal end adjacent to the proximal end of the temperature applicator and a proximal end adjacent to the proximal end of the handle portion whereby the end cap can be removed from the proximal end of the handle portion to allow heat transmissible material to be inserted into and removed from the frusta-conical open inner volume.

34. A temperature-operated drawing implement comprising:

a temperature applicator of heat transmissible material with a body portion and a drawing tip;

a handle portion for retaining the body portion of the temperature applicator wherein the handle portion has a distal end adjacent to the drawing tip of the temperature applicator and a proximal end;

an open inner volume with a given shape and size within the handle portion of the drawing implement for retaining a volume of heat transmissible material in heat transmittable association with the temperature applicator;

a closure device for selectively sealing the open inner volume whereby the open inner volume can be selectively filled with and evacuated of heat transmissible material wherein the closure device comprises an end cap removably couplable with the proximal end of the handle of the drawing implement whereby a volume of heat transmissible material can be selectively inserted into and evacuated from the open inner volume through the proximal end of the handle; and wherein the temperature applicator has a body portion with a proximal end at a mid-portion of the handle portion and wherein the open inner volume has a distal end adjacent to the proximal end of the temperature applicator and a proximal end adjacent to the proximal end of the handle portion whereby the end cap can be removed from the proximal end of the handle portion to allow heat transmissible material to be inserted into and removed from the open inner volume.

* * * * *